US009919353B2

(12) United States Patent
Ziesel et al.

(10) Patent No.: US 9,919,353 B2
(45) Date of Patent: Mar. 20, 2018

(54) METHOD AND DEVICE FOR PRECISION CUTTING OF WORKPIECES IN A PRESS

(71) Applicant: WEBO Werkzeugbau Oberschwaben GmbH, Amtzell (DE)

(72) Inventors: Norbert Ziesel, Amtzell (DE); Axel Wittig, Roggenzell (DE)

(73) Assignee: WEBO WERKZEUGBAU OBERSCHWABEN GMBH, Amtzell (DE)

( * ) Notice: Subject to any disclaimer, the term of this patent is extended or adjusted under 35 U.S.C. 154(b) by 2 days.

(21) Appl. No.: 14/483,412

(22) Filed: Sep. 11, 2014

(65) Prior Publication Data

US 2015/0068375 A1 Mar. 12, 2015

(30) Foreign Application Priority Data

Sep. 11, 2013 (DE) ..... 10 2013 015 180

(51) Int. Cl.

| | |
|---|---|
| ***B26D 7/06*** | (2006.01) |
| ***B26D 1/00*** | (2006.01) |
| ***B21D 45/00*** | (2006.01) |
| ***B21D 28/16*** | (2006.01) |

(52) U.S. Cl.

CPC ..... *B21D 45/003* (2013.01); *B21D 28/16* (2013.01); *Y10T 83/0448* (2015.04); *Y10T 83/2096* (2015.04)

(58) Field of Classification Search

CPC ... B21D 45/003; B21D 28/16; Y10T 83/0448; Y10T 83/2096

USPC .... 83/23, 111, 145, 174, 168, 685–686, 690

See application file for complete search history.

(56) References Cited

U.S. PATENT DOCUMENTS

| | | | | |
|---|---|---|---|---|
| 3,211,034 | A * | 10/1965 | Andris | B21D 28/16 72/329 |
| 3,564,959 | A * | 2/1971 | Harada | B21D 28/16 100/218 |
| 3,570,343 | A * | 3/1971 | Wolnosky | B21D 28/16 83/124 |
| 3,807,678 | A * | 4/1974 | Karnopp | B60G 17/018 188/266.5 |

(Continued)

FOREIGN PATENT DOCUMENTS

| | | |
|---|---|---|
| CN | 201776334 U | 3/2011 |
| DE | 1976624 U | 1/1968 |

(Continued)

OTHER PUBLICATIONS

Canadian Office Action for CN 2,863,345 dated Mar. 21, 2016.
Canadian Office Action for CN 2,863,345 dated Oct. 6, 2016.

*Primary Examiner* — Ghassem Alie
*Assistant Examiner* — Bharat C Patel
(74) *Attorney, Agent, or Firm* — Browdy and Neimark, PLLC

(57) ABSTRACT

A method for precision cutting of workpieces using a press which includes a press frame, in the press opening of which press frame a press ram, that works against a press table, is movably driven, wherein at least one of the press tools is formed as a cutting tool that includes a cutting punch, a downholder, a cutting die and a counter support. The cutting tool operates as a precision cutting tool. A lower tool part of the cutting tool includes a controlled retaining module that retains the counter support in a certain press ram position to enable ejecting the scrap.

8 Claims, 4 Drawing Sheets

(56) References Cited

U.S. PATENT DOCUMENTS 3,939,747 A * 2/1976 Harcuba ..... B21D 28/002 83/556
4,172,415 A * 10/1979 Baltschun ..... B30B 15/285 100/346
4,214,496 A 7/1980 Carrieri
4,425,829 A * 1/1984 Kranik ..... H05K 3/005 234/33
4,531,449 A * 7/1985 Reith ..... F15B 11/003 91/420
4,653,365 A * 3/1987 Takasaki ..... B26F 1/02 83/103
4,774,865 A * 10/1988 Wallis ..... B21D 28/16 267/119
4,877,174 A * 10/1989 Bruhn ..... H01L 21/6835 228/10
4,934,230 A * 6/1990 Wallis ..... B21D 28/16 267/119
4,951,537 A * 8/1990 Bennett ..... B21D 45/006 267/119
5,054,353 A * 10/1991 Haack ..... B21D 28/16 72/335
5,195,413 A * 3/1993 Johnson ..... B23D 15/06 83/132
5,197,718 A * 3/1993 Wallis ..... F16F 9/0218 137/68.23
5,247,862 A * 9/1993 Haack ..... B21D 28/16 83/124
5,339,665 A * 8/1994 Yoshikawa ..... B21D 24/02 72/20.1
6,240,818 B1 * 6/2001 Baltschun ..... B21D 28/16 83/137
6,656,417 B2 * 12/2003 Kohara ..... B22F 3/03 419/66
6,804,983 B2 * 10/2004 Mori ..... B21D 24/02 72/350
7,100,417 B2 * 9/2006 Yamanaka ..... B21D 37/10 72/446
7,194,887 B2 * 3/2007 Aubry ..... B21J 13/03 72/352
7,806,031 B1 * 10/2010 Rytz ..... B21D 28/16 83/390
8,375,765 B2 * 2/2013 Schaltegger ..... B21D 24/14 72/19.9

FOREIGN PATENT DOCUMENTS

DE 1552049 A1 12/1969
DE 293752 A5 9/1991
DE 19908603 C1 11/2000
DE 102005045454 B4 10/2007
EP 0131770 A1 1/1985
EP 245371 A1 4/1993
WO 8702916 A1 5/1987
WO WO 8702916 A1 * 5/1987 ..... B21D 28/16
WO 2009002176 A1 12/2008
WO WO 2009002176 A1 * 12/2008 ..... B21D 28/16

* cited by examiner

METHOD AND DEVICE FOR PRECISION CUTTING OF WORKPIECES IN A PRESS

FIELD

The invention relates to a method and a device for precision cutting of workpieces in a press.

BACKGROUND

A press and a method for hard-cutting has become known from DE 10 2005 045 454 B4 in which at least one spacer forming a solid stop for the press movement is provided in a press tool. The press operates with upper and lower tools, each of which is driven by applying hydraulic pressure, which has the disadvantage that the upper and lower tools have to be supplied by different oil circuits.

In another configuration of this printed matter, the force generators for generating the pressing force of the upper and lower tools are formed by mechanical spring elements. However, an active press tool is not provided in this manner. These press tools only operate passively, namely according to the stroke between the press ram and the press table.

Accordingly, the mentioned spring elements are formed to be passive, that is, they are uncontrolled and generate only a certain pressing force, and no controller is shown and it is not shown how the pressing force is controlled in order to achieve a certain control or feedback control of the press tools.

Another press has become known through DE 199 08 603 C1, which achieves cutting with constant cutting depth.

At the lower tool, the counter punch is supported with an ejector spring. The bottom punch also has an end stop in the lower tool; accordingly, the workpiece is cut against a fixed stop of the counter support in the lower tool.

Due to the uncontrolled ejector spring, the spring characteristics of which cannot be influenced, there is the disadvantage that upon opening the press, the ejector spring in the counter support pushes towards the downholder in the upper part of the tool and thus conveys the stamping scrap back again into the initially stamped blank.

Thus, there is no controlled motion of the power unit that preloads the counter support.

EP 0 131 770 A1 shows generally the principle of fine cutting using a V-ring plate which is punched into the workpiece by the downholder.

DD 293 752 A5 uses a spring pack in the region of the lower part of the tool; however, this is an uncontrolled force generator which is not capable of removing the stamping scrap from the work area of the press in a controlled manner.

In summary, the mentioned prior art can be divided into of presses that operate with hydraulic drive elements which have the disadvantage that laying out the hydraulic circuits and the associate valve involves significant effort with high costs.

The second part of the publications relates to presses that operate purely mechanically, in which, however, the press tools are driven hydraulically. This is apparent in particular from DE 10 2005 045 454 B4.

SUMMARY

It is an object of the invention to improve a method and a device for precision cutting of workpieces in a press in such a manner that precision cutting can be used with less effort in any desired press using any press kinematics.

In order to achieve the given object, the invention is characterized by a method and a device according to the subject matters of the claims.

According to the subject matter of one claim, the method provides that in a press one or more pressing tools are arranged of which at least one is formed as a precision cutting tool which, as a function of the movement of the press ram, has an upper tool part that is driven by the press ram and is provided with a downholder and a cutting punch and that works against a lower tool part, the counter support of which is supported on an energy storage, the compressive force of which can be varied by a pressure accumulator and a check valve connected to the pressure accumulator.

The given technical teaching results in the advantage that a mechanical energy storage in the form of a plate spring pack is preferably used as energy storage for supporting the counter support. This has the advantage that a hydraulic piston and an associated hydraulic pump, an oil reservoir and other hydraulic drive and control elements can be eliminated.

In a preferred configuration, a mechanically acting spring pack (plate spring pack) is used as an element supporting the counter support, wherein the force characteristics of the spring pack can be changed by a pressure accumulator and a check valve interacting with the pressure accumulator.

The present invention is not limited to a precision cutting tool for fine cutting using a ring plate; any cutting or stamping operations (thus, not only fine cutting operations) can also be carried out without using a V-ring plate.

As is well known, fine cutting is a manufacturing method for chipless cutting and, optionally, forming of metal at the same time. It allows producing high-precision parts. In contrast to normal stamping, the raw material is held in place by means of a so-called V-ring plate while the cutting contour is being followed during fine cutting. Only then, a punch having the desired shape cuts the metal. In conjunction with a significantly reduced cutting gap (ca. 0.5% of the sheet metal thickness), a cylindrical cutting ratio of up to 100% of the sheet metal thickness is achieved. It is optionally possible in further steps within the same work sequence to carry out forming or embossing operations on the metal. Thus, this is increasingly referred to as fine cutting/forming.

The invention is not limited thereto. The invention allows a precision cutting tool by means of which it is also possible to carry out simple stamping of material by means of a cutting die.

Likewise, other forming processes can also be carried out with the precision cutting tool according to the invention so that the term "precision cutting tool" according to the invention refers generally to fine cutting/stamping/forming. All three possibilities, in combination with one another or alone, are provided with the precision cutting tool according to the invention.

By using a pressure accumulator, which merely acts in the manner of a piston onto the spring pack on the lower side, there is the advantage that hydraulic circuits, a hydraulic pump, hydraulic oil or complex control elements can be eliminated. Instead, this involves a simple pressure accumulator which does not necessarily operate with hydraulic oil. Pneumatic pressure accumulators are also possible. Accordingly, a complicated high pressure pump that is susceptible to failure can be dispensed with because there is only a pressure accumulator which is alternately filled or emptied according to the work cycles of the press and is subsequently brought back into its initial filling state since the spring pack automatically restores its initial shape (relaxation).

Accordingly, the precision cutting tool according to the invention is not dependent on the drive elements of the press. It operates completely autonomously, which means that the press itself is able to operate according to any method. Thus, this can involve a hydraulic or a mechanical or a servo motor-driven press or other drive kinematics of a press, which are not relevant for the present invention because the drive elements of the press are completely independent of the drive elements of the precision cutting tool.

Accordingly, the features of the invention result for the first time in the advantage that the precision cutting tool can be used in any press with any drive principle and is not dependent on the type of press. Instead of using a conventional tool in the press, it is therefore possible to use the autonomously operating precision cutting tool according to the invention as a further tool. It can be installed together with other tools in a module-like manner in the pressing area without having to rely on kinematics and the drive of the press itself.

It is therefore important for the invention that the counter support of the bottom tool is associated with a preferably mechanical plate spring pack that is connected to a retaining module via a pressure chamber. The retaining module preferably consists of a rechargeable pressure accumulator in connection with a check valve that is arranged in the flow path and the opening and closing state of which is controlled in dependence on the press stroke.

Such a retaining module consisting of the pressure accumulator and the controllable check valve can be arranged in the press tool itself or at any distance from the precision cutting tool—even outside of the press. The pressure accumulator is a pressure container which is filled with a pressure medium such as, for example, air, gas or a hydraulic medium (water or oil), and that should be capable of managing a pressure of approximately 100 to 250 bar.

In case of this pressure module it is important that the pressure of the pressure medium stored therein is sufficient to counteract the spring force of the spring pack in order to retain the latter in a certain processing position of the precision cutting tool.

The subject matter of the present invention results not only from the subject matter of the individual patent claims, but also from the combination of the individual patent claims with each other.

All details and features disclosed in the documents, including the abstract, in particular the spatial configuration illustrated in the drawings, are claimed as being essential for the invention provided that they are novel over the prior art, individually or in combination.

The invention is explained hereinafter in greater detail by means of drawings which merely show an exemplary embodiment. Here, further features and advantages that are essential for the invention are apparent from the drawings and the description thereof.

DETAILED DESCRIPTION

Figure 1:
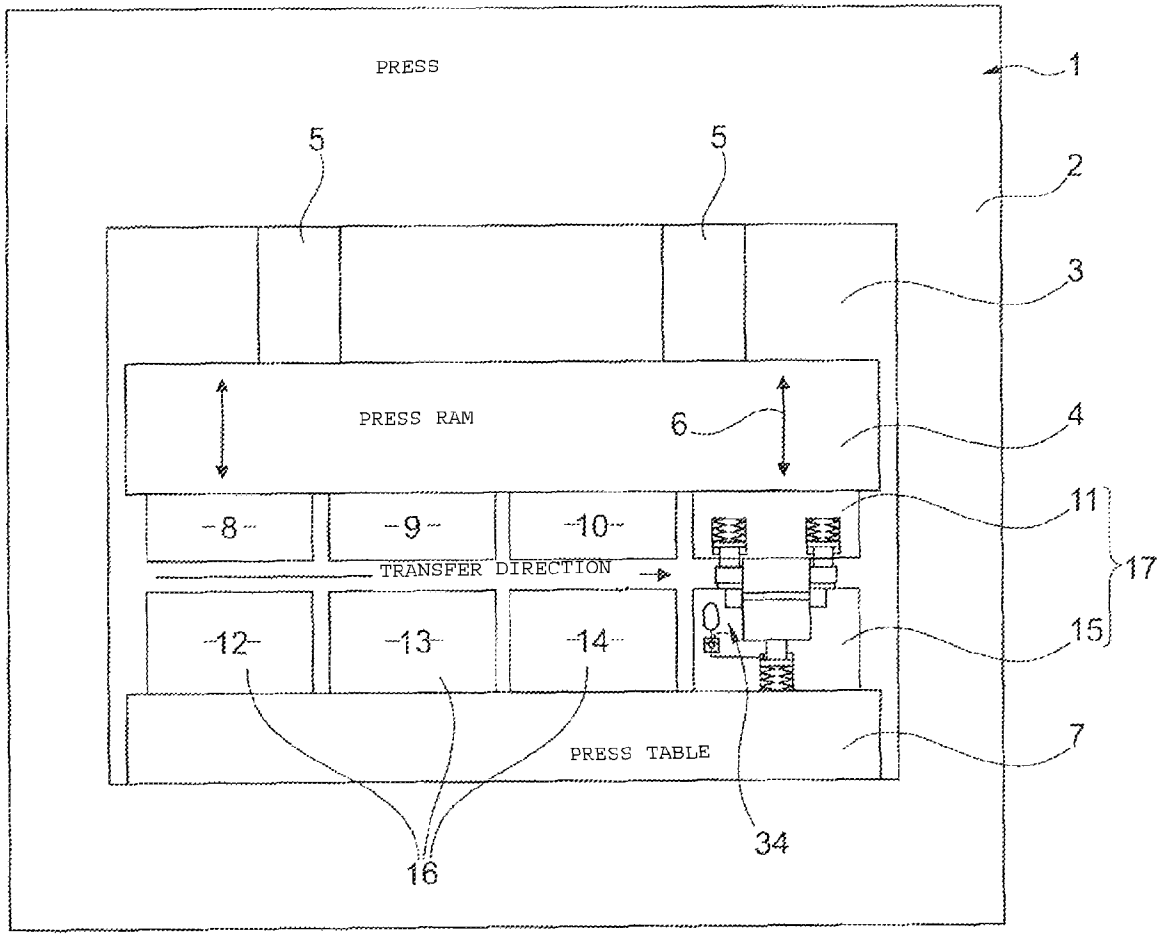
FIG. 1 shows a schematically illustrated press with a number of press tools.

FIG. 1 generally illustrates that a press 1 of any kind has a press frame 2, in the press opening 3 of which a press ram 4 is arranged to be movable via any drive elements 5 in the direction of the arrow 6.

As an example, a number of press tools are arranged in the opening of the press frame 2; the press tools can be of any type or number. It is possible that only a single press tool is arranged in the opening 3 of the press frame 2, but it is also possible that a multiplicity of press tools is arranged therein.

In the present case, it is shown as an example that the first press tool consists of an upper tool part 8 with an associated lower tool part 12.

The lower tool part 12 is in each case fastened on the upper side of the press table 7. The second press tool consists of the upper tool part 9 and the lower tool part 13, the third press tool consists of the upper tool part 10 and the lower tool part 14. In FIG. 1, the transfer direction of the workpiece to be processed in the press 1 in sequential steps is illustrated. First, the workpiece is processed in tool 8, 12, is transferred with the next work cycle into the tool 9, 13 and with the third work cycle into the tool 10, 14.

It is important for the invention that a precision cutting tool 17 according to the invention is arranged in the press frame 2 as a further tool—either alone or in combination with other tools. It consists of an upper tool part 11 and of a lower tool part 15 arranged on the press table 7. In the exemplary embodiment shown, the precision cutting tool 17 is arranged at the end of the processing chain, on the right side of the press frame 2.

The invention is not limited thereto. The precision cutting tool 17 can be installed alone in a press 1 or can alternate in any order with the press tool 8, 12; 9, 13; 10, 14. It is also possible that more than one precision cutting tool 17 is arranged therein.

It is essential for the invention that the lower tool part 15 of the precision cutting tool 17 operates actively, that is, it has an active retaining module 34 that is capable of retaining the counter support 24 (see FIG. 2) in a certain press position in order to enable ejecting of scrap 23.

Figure 2:
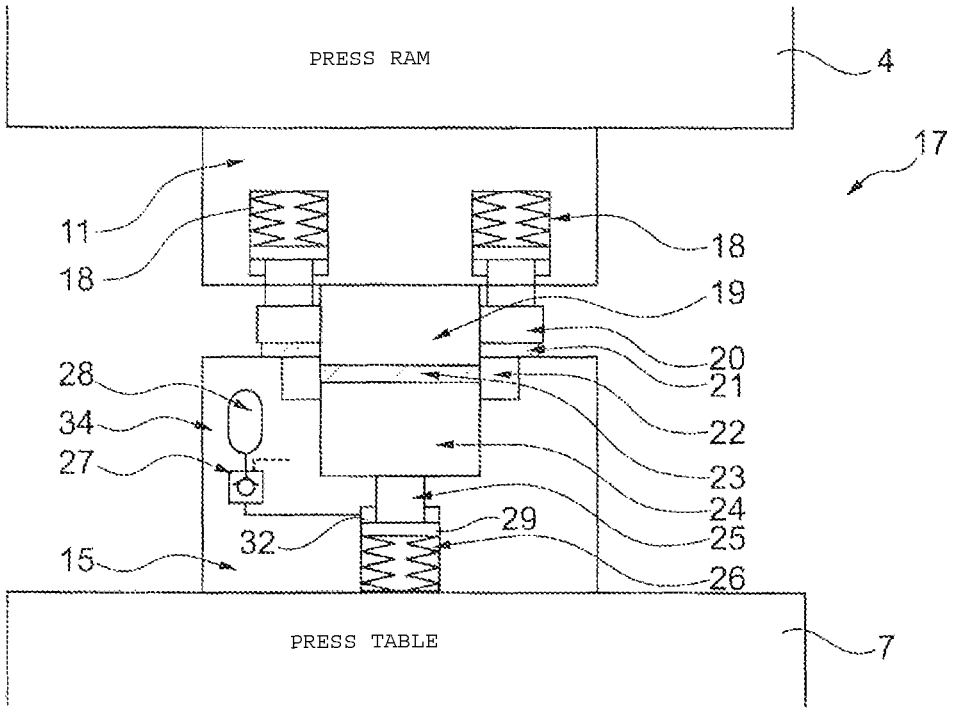
FIG. 2 shows the precision cutting tool according to FIG. 1 in an enlarged illustration.

This is explained in greater detail by means of FIG. 2.

FIG. 2 shows that one or more receptacles for a spring pack 18 are arranged in the upper tool part 11. The respective spring pack preferably comprises plate springs. Instead of such plate springs, other energy storages can also be used such as, for example, hydraulic elements, mechanical springs such as, for example, helical compression springs, spiral or coiled springs or the like.

The spring packs 18 act via associated pressure elements onto the downholder 20. A cutting punch 19 is directly connected to the upper tool part 11.

The cutting punch 19 acts with its cutting edges on a cutting die 22 that is secured on the lower tool part 15. Therebetween, a workpiece 21 is arranged that forms in the middle a piece of scrap that is to be removed in a controlled manner as scrap 23 from the pressing area after cutting out the workpiece 21 is completed.

A counter support 24 is arranged in the lower tool part 15, which counter support carries on its lower side a hydraulic cylinder which engages by means of a pressure plate 29 into a hydraulic cylinder. Above the pressure plate 29 there is a pressure chamber 32 that is pressurized by the pressure of a pressure accumulator 28, wherein a controllable check valve 27 is connected to the pressure chamber 32 in a fluid- or air-conducting manner.

Furthermore, the upper tool part and the lower tool part can switch their functions which would mean that cutting takes place upwards and ejection takes place downwards. Likewise, depending on the component formation, the scrap designated by 23 can represent the workpiece, and 21 can represent the scrap.

The pressure plate 29 is supported on the lower side by an energy storage which, in the preferred exemplary embodiment, is designed as a plate spring pack 26. The invention is not limited thereto.

Instead of a plate spring pack, any other hydraulic, pneumatic or mechanical energy storages can be used. However, use of a spring pack 26 is preferred, because no hydraulic drive elements, high pressure pumps or the like have to be used. This results in that the lower tool part 15 operates actively with the aid of the retaining module 34 formed from the pressure accumulator 28 and the check valve 27 and is not dependent on the press stroke of the press 1.

In the FIGS. 3 to 9, a complete workflow during the operation of the precision cutting tool 17 is illustrated.

Figure 3:
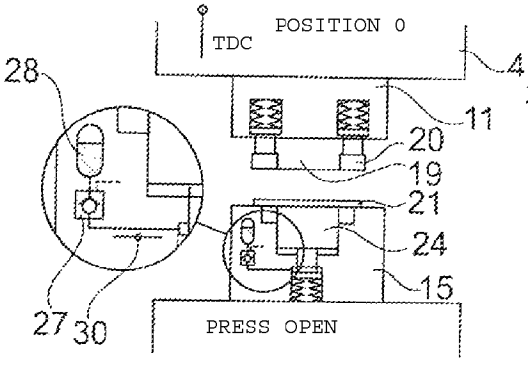
FIG. 3 shows the position 0 of the cutting tool.

FIG. 3 shows the position 0. The press ram 4 is in its TDC and the pressing area is open. The workpiece 21 lies freely on the lower tool part 15 and the retaining module 34 is closed, which means that the pressure accumulator 28 is filled and is pressurized, wherein the check valve 27 is closed. This is illustrated by the solid line with the closed state 30.

Figure 4:
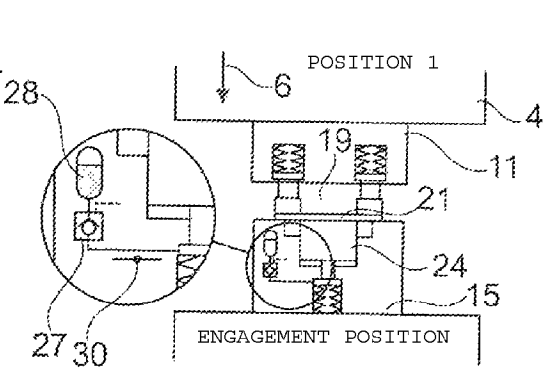
FIG. 4 shows the position 1 of the cutting tool.

In position 1 according to FIG. 4, the press ram travels downwards in the direction of the arrow 6 and closes the pressing area. As a result of this, the downholder 20 is placed onto the workpiece 21 and the cutting punch 19 rests on the upper side of the workpiece 21.

In this position, the pressure accumulator in the retaining module 34 is closed. In the position 2, the press ram 4 according to FIG. 5 travels further downwards in the direction of the arrow 6, as a result of which the cutting punch 19 cuts through the workpiece 21 and forms a central piece of scrap 23. Thereby, the spring pack is preloaded. Under the action of the force of the spring packs 18, the downholder clamps the workpiece 21 before the cutting punch 19 performs the cutting operation on the workpiece 21.

While the counter support 24 travels downwards, the hydraulic piston 25 with its pressure plate 29 travels at the same time into the hydraulic cylinder in the lower tool part 15 so that the pressure chamber 32 expands and thus suctions the pressure medium from the pressure accumulator 28 with the check valve 27 being automatically open in this closed state.

Figure 5:
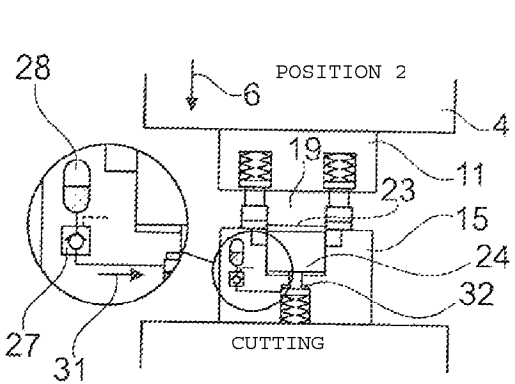
FIG. 5 shows the position 2 of the cutting tool.
Figure 6:
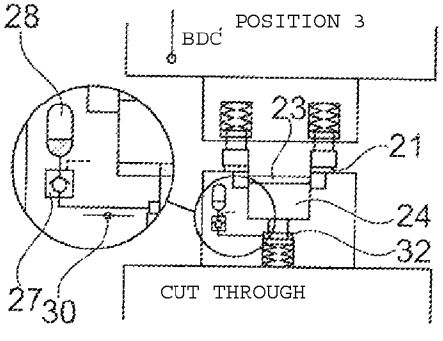
FIG. 6 shows the position 3 of the cutting tool.
Figure 8:
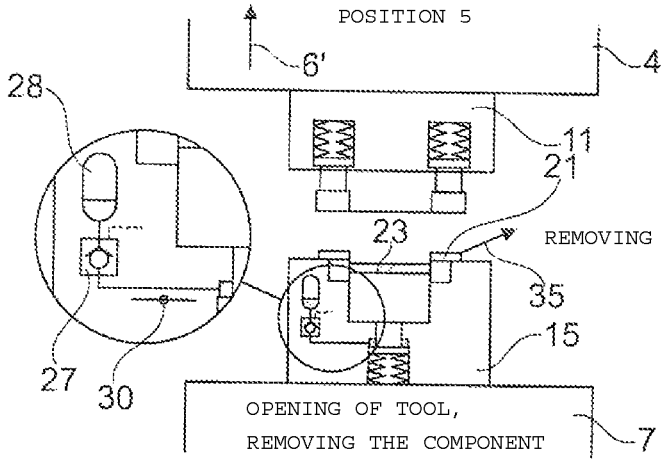
FIG. 8 shows the position 5 of the cutting tool.

In the position 3 according to FIG. 6, the cut state of the workpiece is illustrated. The scrap 23 lies on the counter support 24, and the bottom dead center of the press is therefore reached. In this state, the maximum filling level of the pressure chamber 32 is reached and the pressure accumulator is therefore maximally emptied. The check valve 27 goes into its closed state 30. This is contrary to the open state 31 illustrated in FIG. 5.

Figure 7:
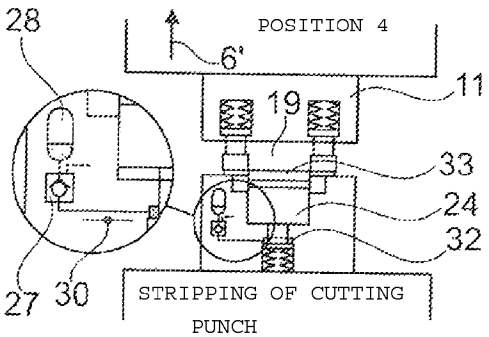
FIG. 7 shows the position 4 of the cutting tool.

When the press ram 4 travels back in the direction of the arrow 6', the check valve 27 remains in the closed state 30; the downholder 20 is released and the cutting punch 19 moves away from the scrap 23. This results in a released position 33 in the region of the workpiece 21 which is now cut out (FIG. 7).

In position 5 (FIG. 8), the press ram 4 travels further upwards in the direction of the arrow 6', thereby increasing the pressing area. The downholder 20 is no longer in contact with the cut workpiece and the cut scrap 23. The check valve 27 remains in its closed position 30 and the finish-cut workpiece 21 is removed in the direction of the arrow 35.

Figure 9:
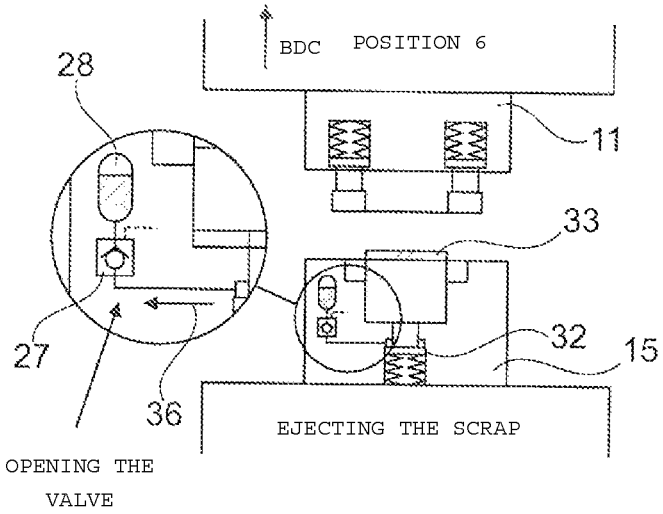
FIG. 9 shows the position 6 of the cutting tool.

In the position 6 according to FIG. 9, the cut out scrap 23 remains on the upper side of the counter support 24, the press ram 4 has reached its top dead center (TDC), the check valve 27 returns into its open state 36 which is contrarily to the fluid flow according to FIG. 5; the pressure chamber is now slowly emptied by the spring force of the spring pack 26; thus, the oil flows in the open state 36 through the open check valve 27 back into the pressure accumulator 28.

This results in that the counter support 24 travels upwards in its initial position to position 0 according to FIG. 3, and the scrap 23 lies above the cutting surface and can be removed without any problems.

An advantage of the method according to the invention and the device carrying out the method is that the tool technology of the precision cutting tool can be accommodated in any press design without being acted on by or being dependent on the press drive elements themselves. The method according to the invention enables a smooth cut portion of more than 70% of the vertical cut surface, whereas with normal cutting, as is well known, a smooth cut portion of approximately 30% and a fractured surface of 70% in the cutting surface can be implemented.

The illustrated construction of the precision cutting tool is more cost-effective compared to conventional, hydraulically driven precision cutting tools, and very high numbers of stroke with more than 80 strokes per minute can be achieved, which, when using hydraulically driven precision cutting tools, is possible only with significantly higher effort and significantly higher costs.

Thus, the invention is characterized by a precision cutting tool which, in the region of its counter support, has a hydraulic piston that interacts with a hydraulic cylinder which on one of its sides has a pressure chamber for a pressure accumulator, and on its opposing side it has a preferably mechanical energy storage. This is an autonomous precision cutting tool which actively performs a retention movement for the counter support in a certain work cycle, without such a movement being dependent on the press elements themselves.

The opening and closing movement of the check valve is controlled by the movement of the press ram 4. For this, any control elements can be used such as, for example, mechanical or electronic position measuring elements and associated control devices, as well as electronic coupling to the press controller which likewise evaluates the position of the press ram. Due to its small number of movable parts, the entire precision cutting tool is low-maintenance, in particular because hydraulically driven elements can be dispensed with.

According to one embodiment more fully described above, a method for precision cutting of workpieces using a press (1) comprises a press frame (2), a press ram disposed in the press opening (3) of which press frame (4), a press table (7) against which the press ram works, the press ram being movably driven, a plurality of press tools, at least one of the press tools (8, 12; 9, 13; 10, 14; 11, 15; 17) is being formed as a cutting tool that comprises at least of a cutting punch (19), a downholder (20), a cutting die (22) and a counter support (24), wherein the cutting tool operates as a precision cutting tool (17), the lower tool part (15) comprises a controlled retaining module (34) that retains the counter support (24) in a certain press ram position to enable ejecting of the scrap (23). The method comprises providing an energy storage to support the counter support (24) arranged in the lower tool part (15) (25, 26, 29, 32), and varying compressive force of the energy storage using a pressure accumulator (28) and a check valve (27) that is connected to the pressure accumulator (28).

According to one embodiment, the method further comprises performing a retaining movement using the precision cutting tool (17) for the counter support (24) in a certain work cycle, said movement being independent of the press tools or tool-external active devices (e.g. hydraulic aggregate) themselves.

According to one embodiment, a mechanically acting plate spring pack or other mechanical energy storages (26) is used as an element supporting the counter holder (24), wherein the method further comprises varying force characteristics of said element by the pressure accumulator (28) and the check valve (27) interacting with the pressure accumulator (28) and by a position of the press ram.

According to one embodiment, a press for precision cutting of workpieces using a press frame (2) is provided, comprising a press ram (4) disposed in a press opening of the press frame, a press table (7) movably driven to work against the press ram (4), and press tools (8, 12; 9, 13; 10, 14; 11, 15; 17) connected to the press ram and the press table. At least one of the press tools is formed as a cutting tool that comprises a cutting punch (19), a downholder (20), a cutting die (22) and a counter support (24). The cutting tool operates as a precision cutting tool (17) and comprises an energy storage (25, 26, 29, 32) supporting the counter support (24) arranged in a lower tool part (15), a pressure accumulator (28), and a check valve (27) connected to the pressure accumulator to vary a compressive force of the energy storage (25, 26, 29, 32).

According to one embodiment, the energy storage is formed as a plate spring pack (26).

According to one embodiment, the press further comprises a piston-cylinder unit (25, 29, 32) connected between the counter support (24) and the energy storage to enable the counter support (24) to act on the energy storage.

According to one embodiment, open and closed states of the check valve (27) are controlled in dependence on a press stroke or the press ram position.

According to one embodiment, the cutting tool comprises a hydraulic cylinder (26) formed in the lower tool part (15), a hydraulic piston (25) connected to a lower side of the counter support (24), a pressure plate (29) connected to the hydraulic piston (25) that engages into the hydraulic cylinder (26), and a pressure chamber (32) formed above the pressure plate (29), that is pressurized by the pressure of the pressure accumulator (28). The check valve (27) is connected to the pressure chamber (32) in a fluid- or air-conducting manner to control the pressure in the pressure chamber (32).

According to one embodiment, a precision cutting tool (17) is provided which is suitable for mounting into a press frame (2), in the press opening (3) of which press frame a press ram (4), that works against a press table (7), is movably driven, and which comprises a cutting punch (19), a downholder (20), a cutting die (22) and a counter support (24), wherein the counter support (24) arranged in a lower tool part (15) is supported on an energy storage (25, 26, 29, 32), the compressive force of which can be varied by a pressure accumulator (28) and a check valve (27) connected to the pressure accumulator (28).

According to one embodiment, in the precision cutting tool (17), the energy storage is a spring pack, in particular a plate spring pack.

REFERENCE LIST

1 Press
2 Press frame
3 Opening
4 Press ram
5 Drive element
6 Direction of arrow 6'
7 Press table
8 Upper tool part
9 Upper tool part
10 Upper tool part
11 Upper tool part
12 Lower tool part
13 Lower tool part
14 Lower tool part
15 Lower tool part
16 Indication arrow
17 Precision cutting tool (active)
18 Spring pack
19 Cutting punch
20 Downholder
21 Workpiece
22 Cutting die
23 Scrap
24 Counter support
25 Hydraulic piston
26 Spring pack
27 Check valve
28 Pressure accumulator
29 Pressure plate
30 Closed state
31 Open state
32 Pressure chamber
33 Released position
34 Retaining module
35 Direction of arrow
36 Open state

The invention claimed is:

1. A press for precision cutting of workpieces using a press frame, comprising:

a press ram disposed in a press opening of the press frame, a press table movably driven to work against the press ram, press tools connected to the press ram and the press table, wherein at least one of said press tools comprises a precision cutting tool that comprises:

an upper tool part and a lower tool part;

a spring pack arranged in the upper tool part;

a cutting punch for cutting a workpiece into a workpiece product and a scrap piece;

a downholder connected to the spring pack and to the cutting punch to clamp the workpiece in place and position the cutting punch on the workpiece for cutting during use responsive to action of a biasing force of the spring pack;

a cutting die secured to the lower tool part and on which the cutting punch acts when the workpiece is being cut on a cutting surface;

a counter support arranged on the lower tool part disposed so as to receive the scrap and move downwardly within the lower tool part below and out of the plane of the cutting surface;

an energy storage supporting the counter support and arranged in the lower tool part, the energy storage configured and operable to cause the counter support to move between a first position coincident with the cutting surface and a second position below and out of the plane of the cutting surface via a fluid;

a pressure accumulator in fluid communication with the energy storage to pressurize the fluid in the energy storage to control the energy storage to move the counter support between the first and second positions;

a check valve connected to the pressure accumulator to vary a compressive force on the energy storage causing the energy storage to move independently of a press stroke of the press ram;

an enclosed energy store chamber;

a pressure plate;

a cylinder connected between the pressure plate and the counter support;

a spring pack disposed in the enclosed energy store chamber and supporting the pressure plate; and a pressure chamber separated from the energy store chamber by the pressure plate, the pressure accumulator being in fluid communication with the pressure chamber, wherein the fluid runs into the pressure chamber from the pressure accumulator, wherein the press is configured such that on downward stroke of the press ram in a direction toward the press table, the spring pack is compressed, in the upper tool part, and fluid runs into the energy storage from the pressure accumulator at the same time, wherein on the up stroke of the press ram in a direction away from the press table, the counter support is driven upwards by the energy storage, and wherein the fluid stored in the pressure accumulator controls movement of the counter support in the upward stoke of the press ram.

2. The press according to claim 1, wherein the energy storage is formed as a plate spring pack.

3. The press according to claim 1, further comprising a piston-cylinder unit connected between the counter support and the energy storage to enable the counter support to act on the energy storage.

4. The press according to claim 1, wherein open and closed states of the check valve are controlled in dependence on a press stroke or the press ram position.

5. The press according to claim 1, wherein the cutting tool comprises:

a hydraulic cylinder formed in the lower tool part, a hydraulic piston connected to a lower side of the counter support, a pressure plate connected to the hydraulic piston that engages into the hydraulic cylinder, a pressure chamber formed above the pressure plate, that is pressurized by the pressure of the pressure accumulator, wherein the check valve is connected to the pressure chamber in a fluid- or air-conducting manner to control the pressure in the pressure chamber.

6. A precision cutting tool which is suitable for mounting into a press frame, the press frame having a press opening, and a press ram, that works against a press table, being movably driven in the press opening, and which comprises:

an upper tool part and a lower tool part;

a spring pack arranged in the upper tool part;

a cutting punch for cutting a workpiece into a workpiece product and a scrap piece;

a downholder connected to the spring pack and to the cutting punch to clamp the workpiece in place and position the cutting punch on the workpiece for cutting during use responsive to action of a biasing force of the spring pack;

a cutting die secured to the lower tool part and on which the cutting punch acts when the workpiece is being cut on a cutting surface;

a counter support arranged on the lower tool part disposed so as to receive the scrap and move downwardly to move the scrap within the lower tool part below and out of a plane of the cutting surface;

an energy storage supporting the counter support and arranged in the lower tool part, the energy storage configured and operable to cause the counter support to move between a first position coincident with the cutting surface and a second position below and out of the plane of the cutting surface via a fluid, a pressure accumulator in fluid communication with the energy storage to pressurize the fluid in the energy storage to control the energy storage to move the counter support between the first and second positions; and a check valve connected to the pressure accumulator to vary a compressive force on the energy storage causing the energy storage to move independently of a press stroke of the press ram;

an enclosed energy store chamber;

a pressure plate;

a cylinder connected between the pressure plate and the counter support;

a spring pack disposed in the enclosed energy store chamber and supporting the pressure plate; and a pressure chamber separated from the energy store chamber by the pressure plate, the pressure accumulator being in fluid communication with the pressure chamber, wherein the fluid runs into the pressure chamber from the pressure accumulator, wherein the press is configured such that on downward stroke of the press ram in a direction toward the press table, the spring pack is compressed, in the upper tool part, and the fluid runs into the energy storage from the pressure accumulator at the same time, wherein on the up stroke of the press ram in a direction away from the press table, the counter support is driven upwards by the energy storage, and wherein the fluid stored in the pressure accumulator controls movement of the counter support in the upward stoke of the press ram.

7. The precision cutting tool according to claim 6, wherein the energy storage is a spring pack.

8. The precision cutting tool according to claim 6, wherein the energy storage is a plate spring pack.

* * * * *